US007313985B2

(12) United States Patent
Willis

(10) Patent No.: US 7,313,985 B2
(45) Date of Patent: Jan. 1, 2008

(54) RAPID ROOF REMOVER

(76) Inventor: Douglas Carter Willis, 4734 Old St. Rt. 35 SE., Washington C. H., OH (US) 43160

( * ) Notice: Subject to any disclaimer, the term of this patent is extended or adjusted under 35 U.S.C. 154(b) by 47 days.

(21) Appl. No.: 11/396,497

(22) Filed: Apr. 3, 2006

(65) Prior Publication Data

US 2007/0186728 A1 Aug. 16, 2007

Related U.S. Application Data

(60) Provisional application No. 60/669,371, filed on Apr. 8, 2005.

(51) Int. Cl.
*B25B 33/00* (2006.01)

(52) U.S. Cl. ..... 81/45; 81/44; 81/46; 30/167; 30/169

(58) Field of Classification Search ..... 81/44–46; 30/167, 167.1, 167.2, 169, 170–172
See application file for complete search history.

(56) References Cited

U.S. PATENT DOCUMENTS

| | | | | | |
|---|---|---|---|---|---|
| 4,858,503 | A | * | 8/1989 | Dike, Jr. | 81/45 |
| D378,044 | S | * | 2/1997 | Benjamin | D8/88 |
| D439,126 | S | * | 3/2001 | Gohman | D8/89 |
| 6,711,971 | B1 | * | 3/2004 | Morin | 81/45 |
| D500,239 | S | * | 12/2004 | Parker et al. | D8/89 |

* cited by examiner

*Primary Examiner*—Lee D. Wilson
*Assistant Examiner*—Anthony Ojini
(74) *Attorney, Agent, or Firm*—Standley Law Group LLP

(57) ABSTRACT

In the past shingles and nails were removed from a roof by means of a shovel, pitch fork, or shingle removal tool. All of these methods require intense physical labor, and because of the small width of the available tools are very time consuming to achieve the desired results. The Rapid Roof Remover alleviates the need for intense physical labor by levering the shingles and nails from the wood they are attached to by the action of the tear-off blade (up to 36 inches in width) being levered back by the pneumatic cylinder.

2 Claims, 2 Drawing Sheets

RAPID ROOF REMOVER

CROSS-REFERENCE TO RELATED APPLICATIONS

This application claims the benefit of U.S. Provisional Application No. 60/669.371 filed on Apr. 08. 2005.

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

The Rapid Roof Remover is a pneumatic tool for the removal of shingles and nails from roofs. Prior to this invention the most common practice of removing shingles and nails consisted of immense physical labor to do the job by the standard shingle removal shovel.

BRIEF SUMMARY OF THE INVENTION

The Rapid Roof Remover operates by using air pressure from a standard air compressor. A switch in the handle engages a pneumatic cylinder located in the housing platform that lever back the tear-off blade located on the front of the machine. The advantage of using air pressure for the removal of shingles opposed to physical labor is quite extensive. Not only does the Rapid Roof Remover have blades as wide as 36 inches (tear-off shovels are between seven and nine inches wide), but the exhaust air is directed so as to clean the roof of small debris which could cause a person to slip or lose footage while on steep pitched roofs.

DETAILED DESCRIPTION OF THE INVENTION

Figure 1:
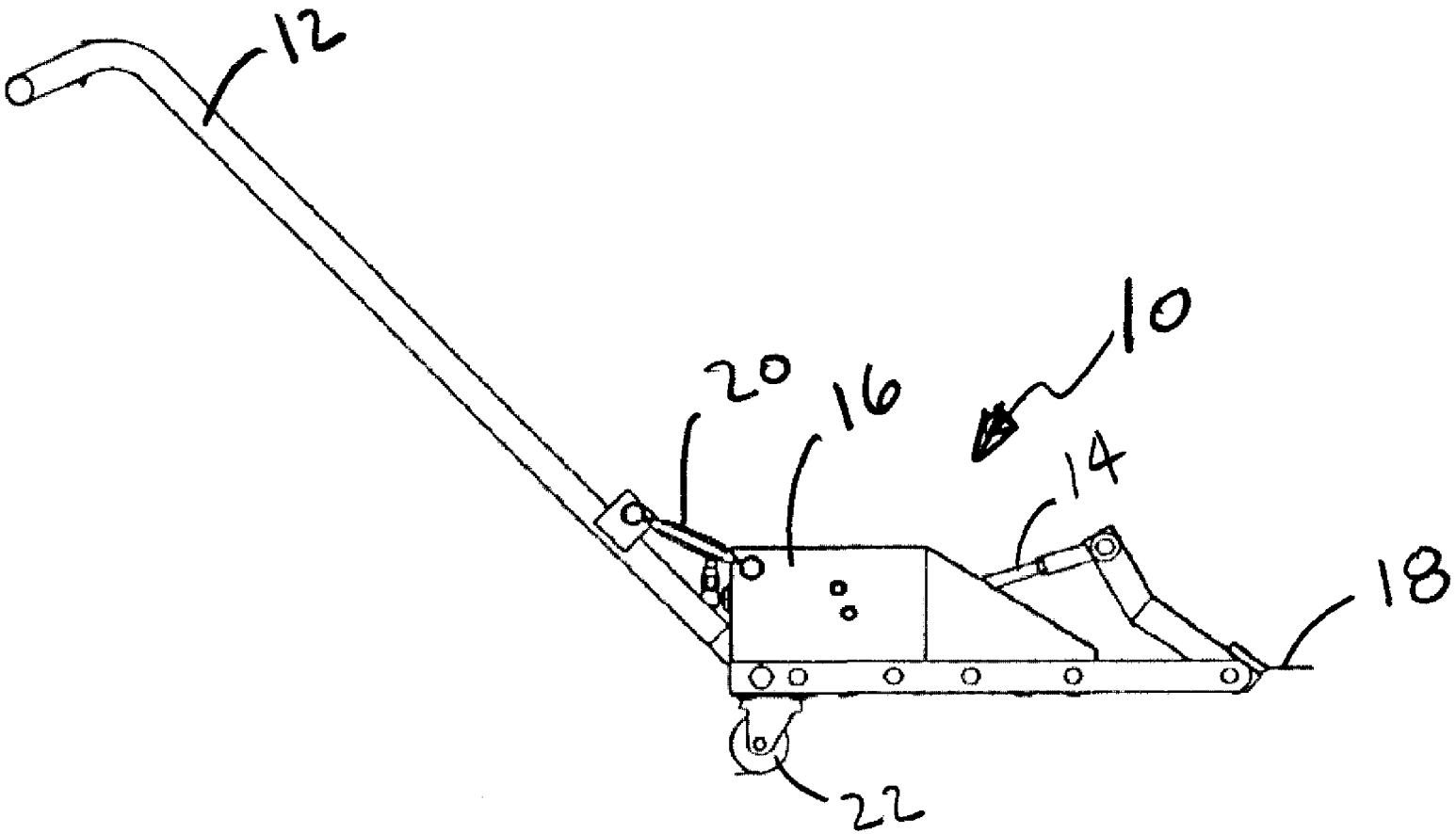
FIG. 1—Side view of machine
FIG. 2—Top view of machine
Figure 2:
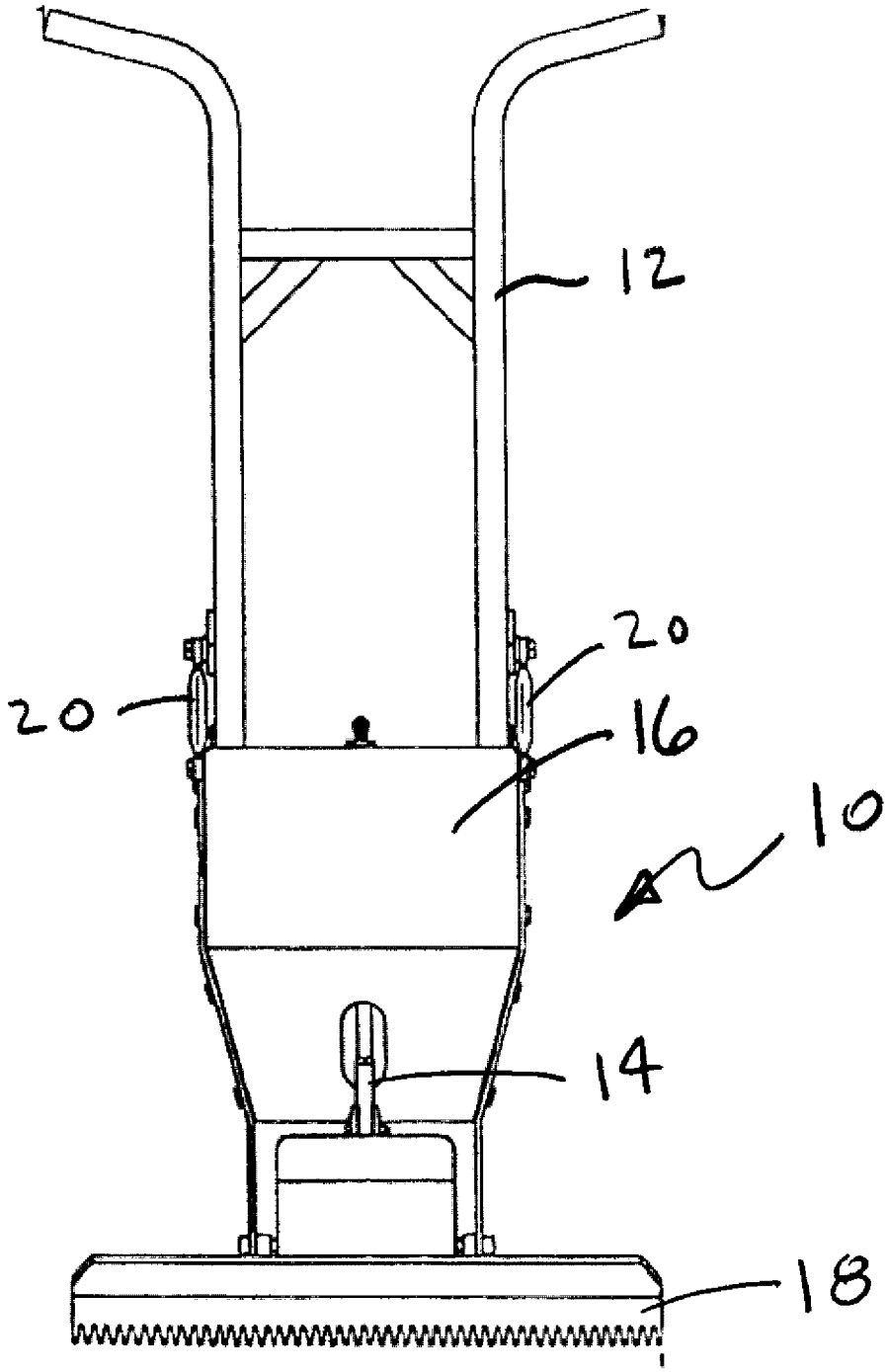

The Rapid Roof Remover is a platform based tool 10 for the removal of shingles and nails from roofs with various pitches. The Rapid Roof Remover operates by air pressure from a standard air compressor. A switch located in the handle 12 engages a pneumatic cylinder 14 located in the housing platform 16 that lever back the tear-off blade 18 located at the front of the machine 10. Nails, as well as shingles, are broken free by this action. The shingles are lifted from the roof in large sections for easy clean-up and removal. Different pitches of roofs can easily be accommodated by adjusting the length of the turnbuckle 20 located between the handle 12 and the housing platform 16. Heavy-duty casters 22 located on the rear of the platform 16 make for easy maneuverability of the machine 10 on the roof. The improvement that is achieved by using the Rapid Roof Remover is a much quicker and less labor intensive removal of shingles and nails from roofs being removed for the purpose of new roofing being applied.

What is claimed is:

1. A tool for the removal of shingles and nails from an existing roof of a structure, comprising:

a handle;

a housing connected to an end of the handle;

rolling means in association with the housing;

a blade extending from the housing said blade adapted to move under shingles previously applied to a roof surface; and a pneumatic cylinder, at least partially within the housing, connected to the blade to adjust the blade relative to the roof surface.

2. The tool of claim 1, further comprising a turnbuckle connection between said handle and said housing.

* * * * *